US006255611B1

(12) United States Patent
Chou

(10) Patent No.: US 6,255,611 B1
(45) Date of Patent: Jul. 3, 2001

(54) PUSHBUTTON SWITCH

(75) Inventor: Chin-Wen Chou, Taipei (TW)

(73) Assignee: Shin Jiuh Corp., Hsin-Tien (TW)

( * ) Notice: Subject to any disclaimer, the term of this patent is extended or adjusted under 35 U.S.C. 154(b) by 0 days.

(21) Appl. No.: 09/505,848

(22) Filed: Feb. 17, 2000

(51) Int. Cl.[7] ..... H01H 5/08; H01H 13/26; H01H 21/02

(52) U.S. Cl. ..... 200/520; 200/461; 200/467; 200/539; 200/553

(58) Field of Search ..... 200/520–536, 200/402, 408, 412, 420–472, 5 A, 403–407, 409–411, 413–419, 537–574

(56) References Cited

U.S. PATENT DOCUMENTS

| | | | | |
|---|---|---|---|---|
| 2,743,331 | | 4/1956 | Lauder et al. | 200/461 |
| 3,056,866 | | 10/1962 | Karleen | 200/461 |
| 4,011,419 | * | 3/1977 | Anderson | 200/462 |
| 4,045,632 | * | 8/1977 | Pierott | 200/442 |
| 4,055,734 | * | 10/1977 | Hayden | 200/5 A |
| 4,230,919 | | 10/1980 | Schantz et al. | 200/462 |
| 4,348,563 | * | 9/1982 | Henville | 200/452 |
| 4,362,910 | | 12/1982 | Boebel et al. | 200/462 |
| 4,394,553 | | 7/1983 | Feil | 200/462 |
| 4,636,597 | | 1/1987 | Menche | 200/438 |
| 4,673,778 | * | 6/1987 | Lewandowski et al. | 200/467 |
| 4,877,930 | * | 10/1989 | Fukuma | 200/467 |
| 4,902,863 | * | 2/1990 | Fukuma | 200/445 |
| 4,904,832 | * | 2/1990 | Nagahara et al. | 200/402 |
| 5,171,945 | * | 12/1992 | Su | 200/6 R |
| 5,453,590 | | 9/1995 | Mayer | 200/461 |
| 5,566,819 | * | 10/1996 | Lustgarten et al. | 200/407 |
| 5,717,177 | | 2/1998 | Tsai et al. | 200/16 R |

* cited by examiner

*Primary Examiner*—J. R. Scott
(74) *Attorney, Agent, or Firm*—Bacon & Thomas, PLLC

(57) ABSTRACT

A switch for selectively supplying power or signals from a fixed first conductive pin to fixed second and third conductive pins includes a housing, a pushbutton unit including a tappet situated in the housing, a conductive unit including the first, second, and third conductive pins, and a switching unit including a conductive sway element for respectively selectively connecting the first conductive pin to either the second or the third conductive pin. The switching unit also includes an elastic element coupled at a first end with the tappet and at a second end the sway element such that when the first end of the elastic element is in a first position, said elastic element causes the sway element to connect said first and third conductive pins, and when the first end of the elastic element is moved past a critical line to a second position, the elastic element causes the sway element to also move past the critical line and connect the first and second conductive pins.

7 Claims, 5 Drawing Sheets

PUSHBUTTON SWITCH

BACKGROUND OF THE INVENTION

This invention relates to an improved pushbutton switch, and particularly to a pushbutton switch and that can solve the problem of sticking or welding of the common contact point caused by sparks created in the switching process.

A typical conventional switch, such as a microswitch, usually contains a housing including a press unit, a driving element, a switching unit, and a plurality of conductive pins.

One end of an elastic element of the switching unit is connected with the driving element while the other end is connected with a sway element. When an external force is applied onto the press unit, the bottom end of the press unit will press against the driving element to in turn push an elastic element to drive the sway element for switching a common contact point from a contact position in which it contacts a third conductive pin to another contact position in which it contacts a second conductive pin in order to supply power or signals to a load linked with the second conductive pin.

However, in the conventional switch, because the elastic element is driven indirectly, it requires a relatively larger external force to be applied onto the press unit. In addition it is difficult for a maker to cram the abovesaid units or elements into the limited space of the housing resulting in increased assembly costs.

Moreover, because the conventional switch lacks a way to overcome welding or sticking of the sway element to one of the conductive pins driving switching process, operation failure may occur from time to time.

SUMMARY OF THE INVENTION

The primary object of this invention is to provide an improved structure of a pushbutton switch, wherein one end of an elastic element of a switching unit is coupled with a pushbutton unit. When an external force is applied the pushbutton unit, the jointed end of the pushbutton unit and the elastic element is forced to move downwards until it passes a critical line, at which point the sway element is coupled with another conductive pin to supply power or signals.

Another object of this invention is to provide an improved structure of a pushbutton switch wherein a push-to-press portion is used to push a contact point of a sway element away in case the sway element is welded and stuck to a third or a second conductive pin by sparks. As to more detailed information regarding this invention, together with further advantages or features thereof, at least an example of preferred embodiment will be elucidated below with reference to the annexed drawings.

BRIEF DESCRIPTION OF THE DRAWINGS

The related drawings in connection with a detailed description of this invention are listed and described briefly as follows.

DETAILED DESCRIPTION OF THE PREFERRED EMBODIMENT

Figure 1:
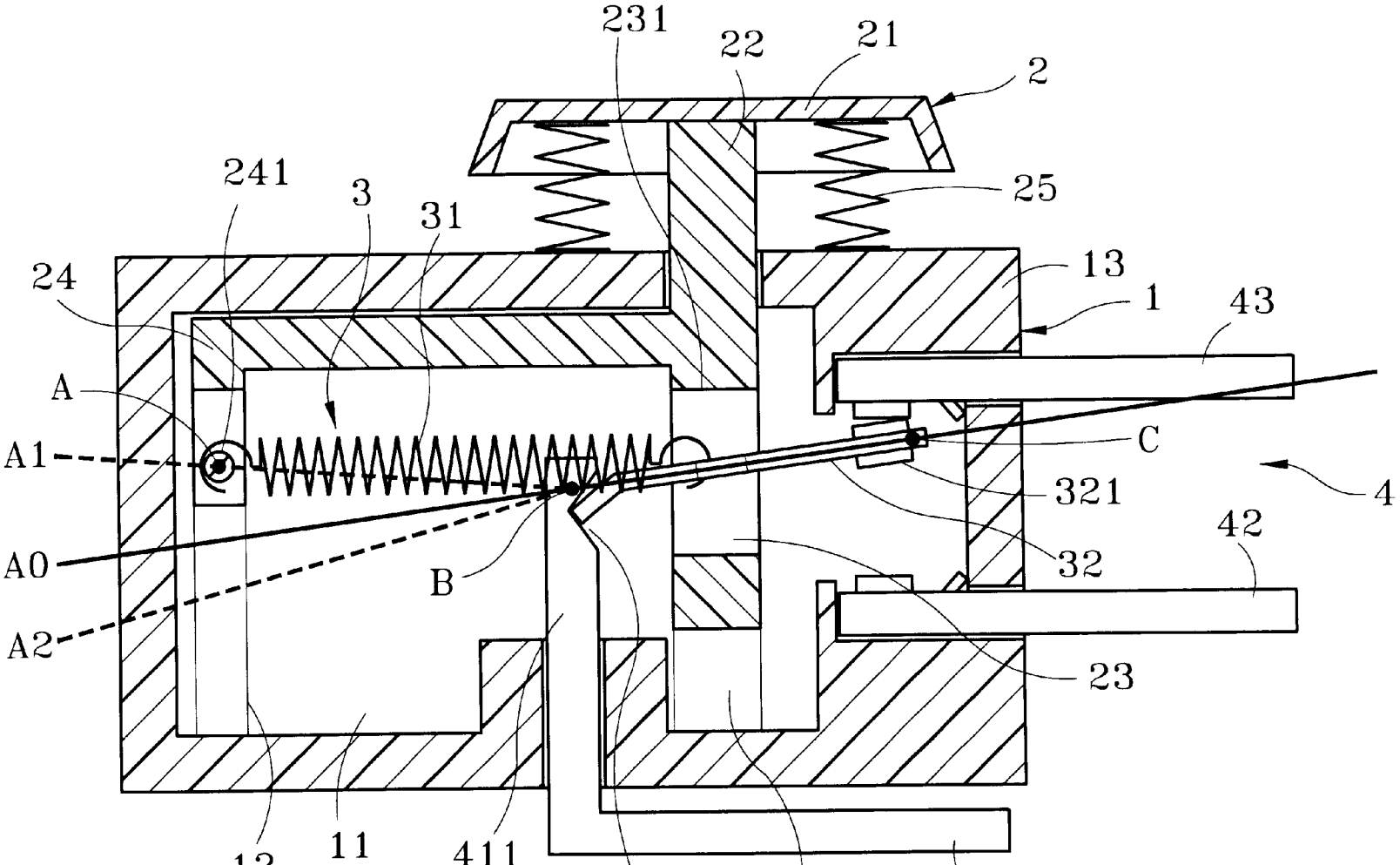
FIG. 1 is a schematic view of a first embodiment of this invention.
Figure 2:
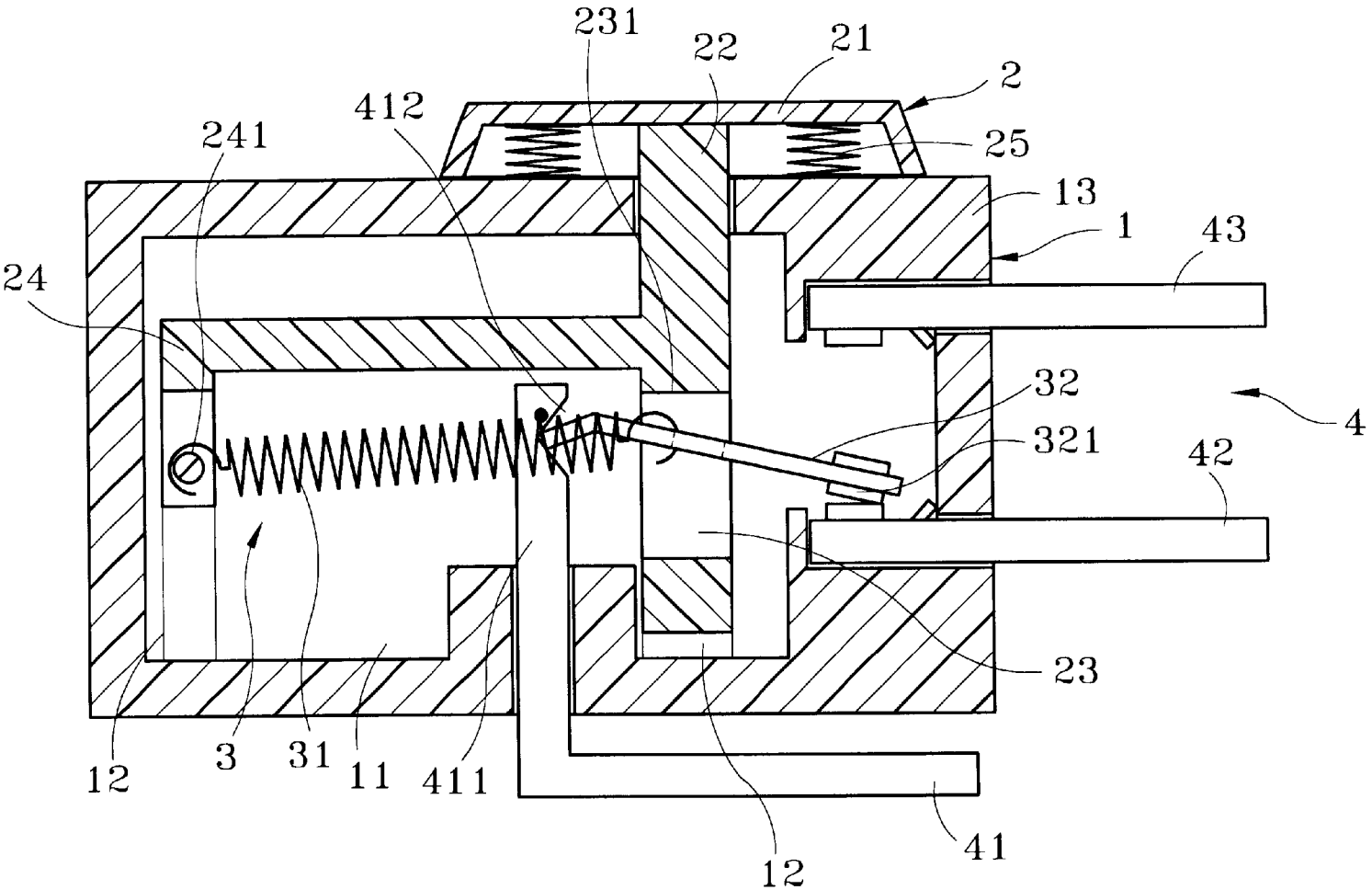
FIG. 2 is a schematic action view of FIG. 1.

As shown in FIG. 1 and FIG. 2—a first embodiment and a schematic action diagram—an improved pushbutton switch of this invention for conducting power or signals comprises a housing 1, a pushbutton unit 2 having a tappet buried in the housing 1, a switching unit 3 arranged to interact with the pushbutton unit 2, and a conductive unit 4 located in the housing 1. When an external force is applied the pushbutton unit 2, the switching unit 3 is driven to conduct power or signals.

In the foregoing housing 1, a vacant space 11 is formed for accepting the action portion of pushbutton unit 2 and the switching unit 3, wherein a plurality of guide portions 12 are disposed in on inner wall of the vacant space 11 to enable the pushbutton unit 2 to move up and down stably in the housing 1. The conductive unit 4 is inserted in a thick portion 13 of the housing The pushbutton unit 2 contains a press portion 21 located on its top end and an interaction portion 22 extending into the housing 1, wherein a through hole 23 is reserved in the interaction portion 22 for the switching unit 3 to extend over; and a push-to-press portion 231 is formed in the inner wall of the through hole 23. The interaction portion 22 is extended perpendicularly to form a driven portion 24 joined with a coupling portion 241 at its farther end, and a restoring element 25 is placed between the press portion 21 and the housing 1 for restoring the pushbutton unit 2 to its original state after an external force applied onto the pushbutton unit 2 is removed.

The switching unit 3 comprises an elastic element 31 and a sway element 32, wherein one end of the elastic element 31 is connected with the coupling portion 241, and the other with the sway element 32 respectively. A common contact point 321 is formed on both faces at a free end of the sway element 32 while the other end presses against a first conductive pin 41 of the conductive unit 4 closely to form a pivotal joint.

The conductive unit 4 comprises the first conductive pin 41 inserted in the thick portion 13 of the housing 1, a second conductive pin 42, and a third conductive pin 43. A support portion 411, extending into the housing 1 is arranged at one end of the first conductive pin 41, and a recess 412 is formed in the support portion 411 allowing the sway element 32 to pivotally press against the support portion 411 of the first conductive pin 41. Moreover, a contact point 421, 431 is formed on the second and the third conductive pin 42, 43 respectively for contact with the common contact point 321 of the sway element 32.

Under normal conditions no external force is applied to the pushbutton unit 2 (herein, the coupling portion 241 joined with the elastic element 31 at point A; one end of the sway element 32 pivotally contacting with the support portion 411 at Point B; point C being taken on behalf of the common contact point 321 of the sway element 32 for simplification), and thus the elastic element 31 drags sway element 32 upwards to have the point C contacted with the third conductive pin 43. When an external force is applied onto the pushbutton unit 2, point A is moved downwards from an original dotted line A1 to a critical solid line A0 where the elastic element 31 and the sway element 32 are aligned in parallel, and the point C is kept motionless. Then, when point A is moved farther to overstep the critical solid line A0 and reach a dotted line A2 (point A passes point B), point C is switched to the contact point 421 of the second conductive pin 42 so that the power or signals will be imposed on the second conductive pin 42 via the first conductive pin 41 for supplying power or signals to a load (not shown). conversely, when the external force applied onto the pushbutton unit 2 is removed then the elastic force of the restoring element 25 restores the point A back to the dotted line A1.

In case switching the point C from the third conductive pin 43 to the second conductive pin 42 is desired, a user is supposed to press the pushbutton unit 2 down to drive the point A downwards until it reaches the position on the dotted line A2 via the solid critical line A0 as abovesaid. However, he may be disappointed sometimes that the job cannot be done because the point C is stuck or slightly welded at the contact point 431 of the third conductive pin 43 by sparks. In this situation, he may use the push-to-press portion 231 in the through hole 23 to press the sway element 32 down (or up, if the point C is stuck at the contact point 421 of the second conductive pin 42) to unstick the point C for normal operation.

Figure 3:
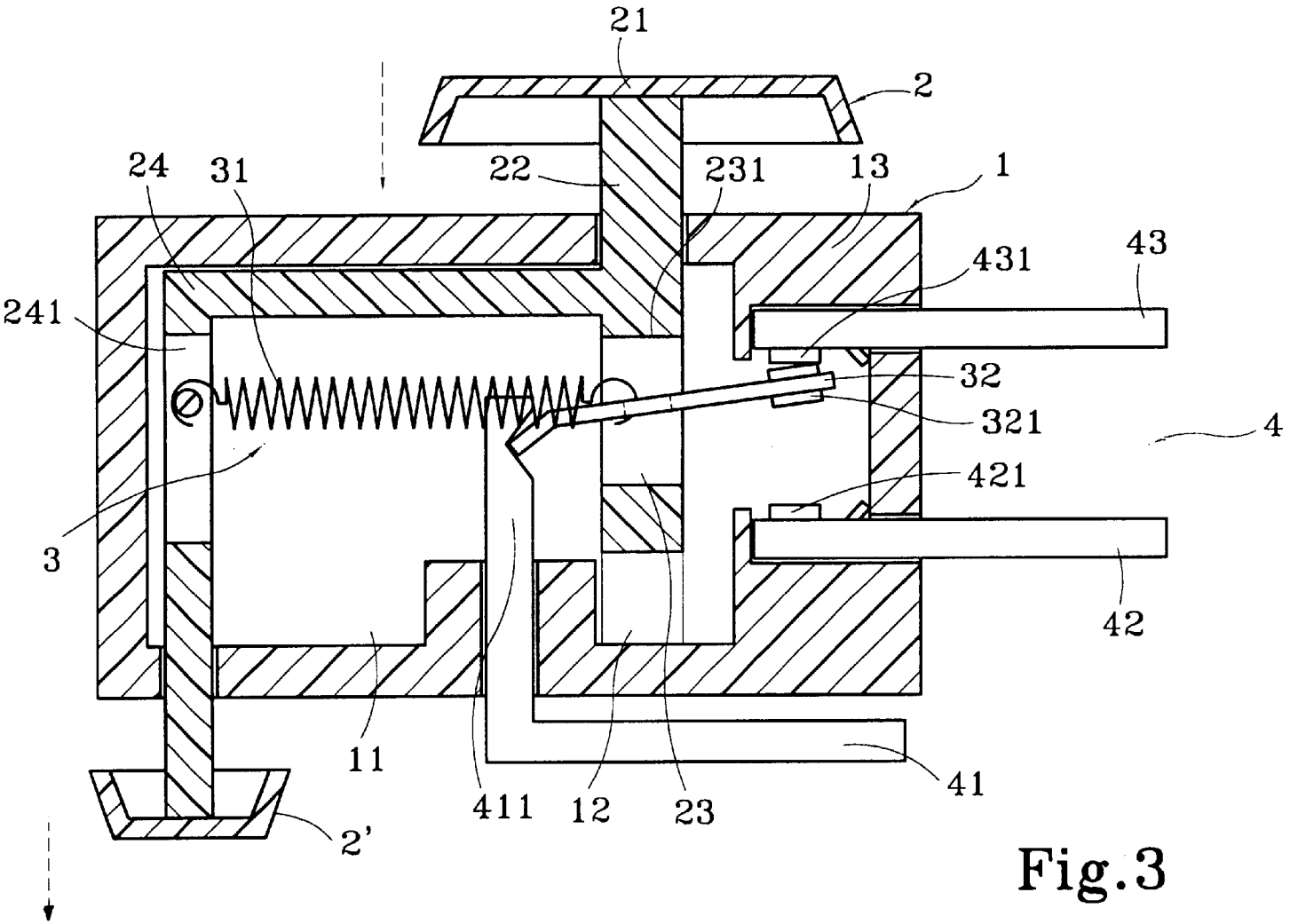
FIG. 3 is a schematic view of a second embodiment of this invention.

Referring to FIG. 3—a second embodiment of this invention —there is no restoring element 25 inserted between the press unit 2 and the housing 1. When an external force is applied onto the press unit 2, the common contact point 321 of the sway element 32 is switched to contact with the contact point 421 of the second conductive pin 42. The user may push another press unit 2' with a tappet connecting to the driven portion 24 of the press unit 2 upwards to release the contact point 32 to go back to the contact point 431 of the third conductive pin 43.

Figure 4:
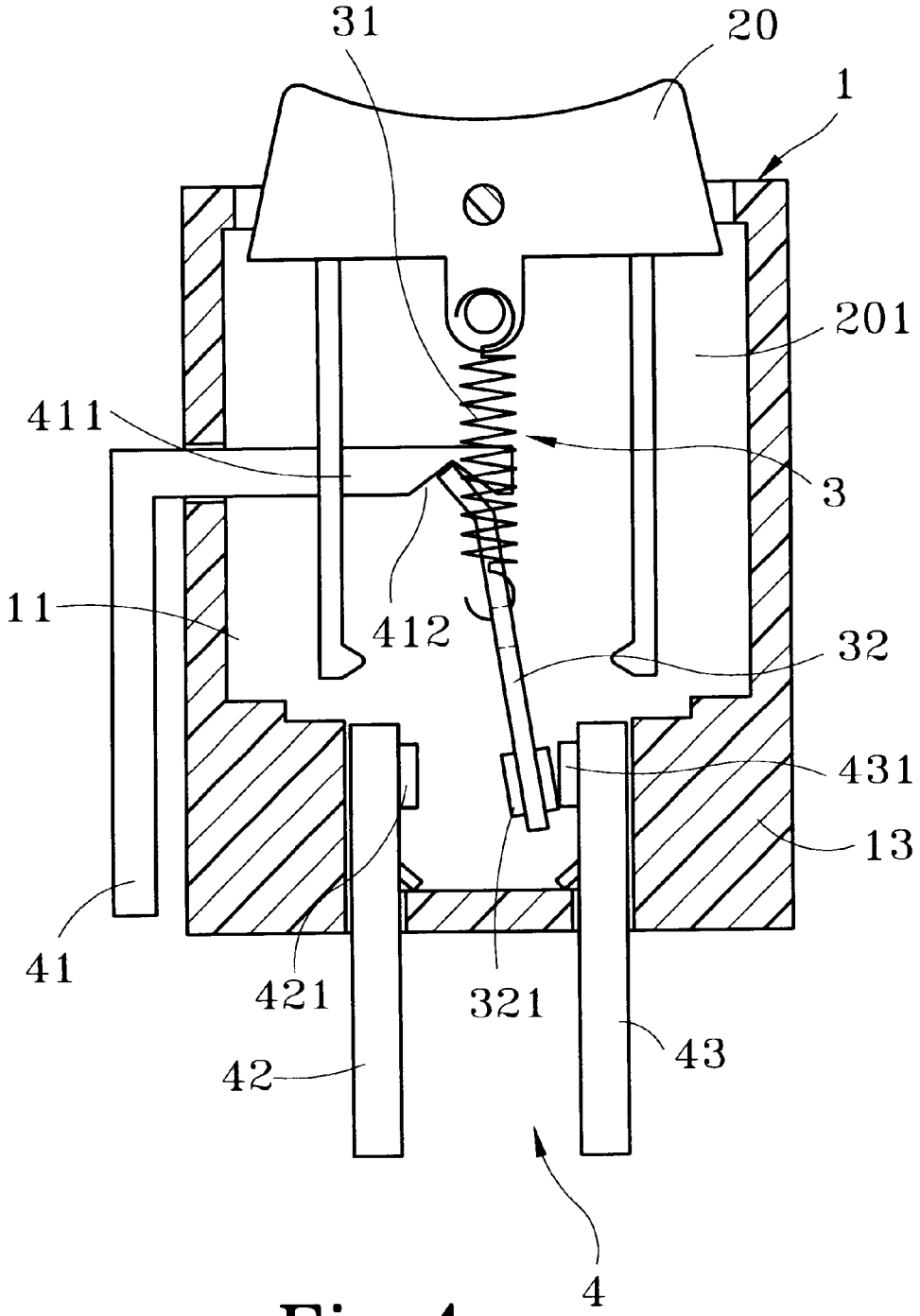
FIG. 4 is a schematic view of a third embodiment of this invention.

According to a third embodiment of this invention shown in FIG. 4, the press unit 2 is made in form of a rocker 20. When one end of the rocker 20 is pressed downwards to drive the point A (as shown in FIG. 1) to move over the critical line, the point C will be switched from the contact point 431 of the third conductive pin 43 to the contact point 421 of the second conductive pin 42. In this case, a push-to-press portion 201 extended from a bottom end of the seesaw 20 is substituted for the foregoing push-to-press portion 231 for the same function without needing, repeated elucidation.

The advantage of the third embodiment is that one end of the elastic element 31 is secured directly with the rocker 20 so that the action of the elastic element 31 is more reliable when an external force is applied onto the seesaw 20, and meanwhile, a driving element can be omitted in fabrication or assembly for cost saving. When the sway element 32 is welded and stuck to the third or the second conductive pin 43, 42 by sparks, a user may use the push-to-press portion 201 to press against the sway element 32 for releasing the same.

Figure 5:
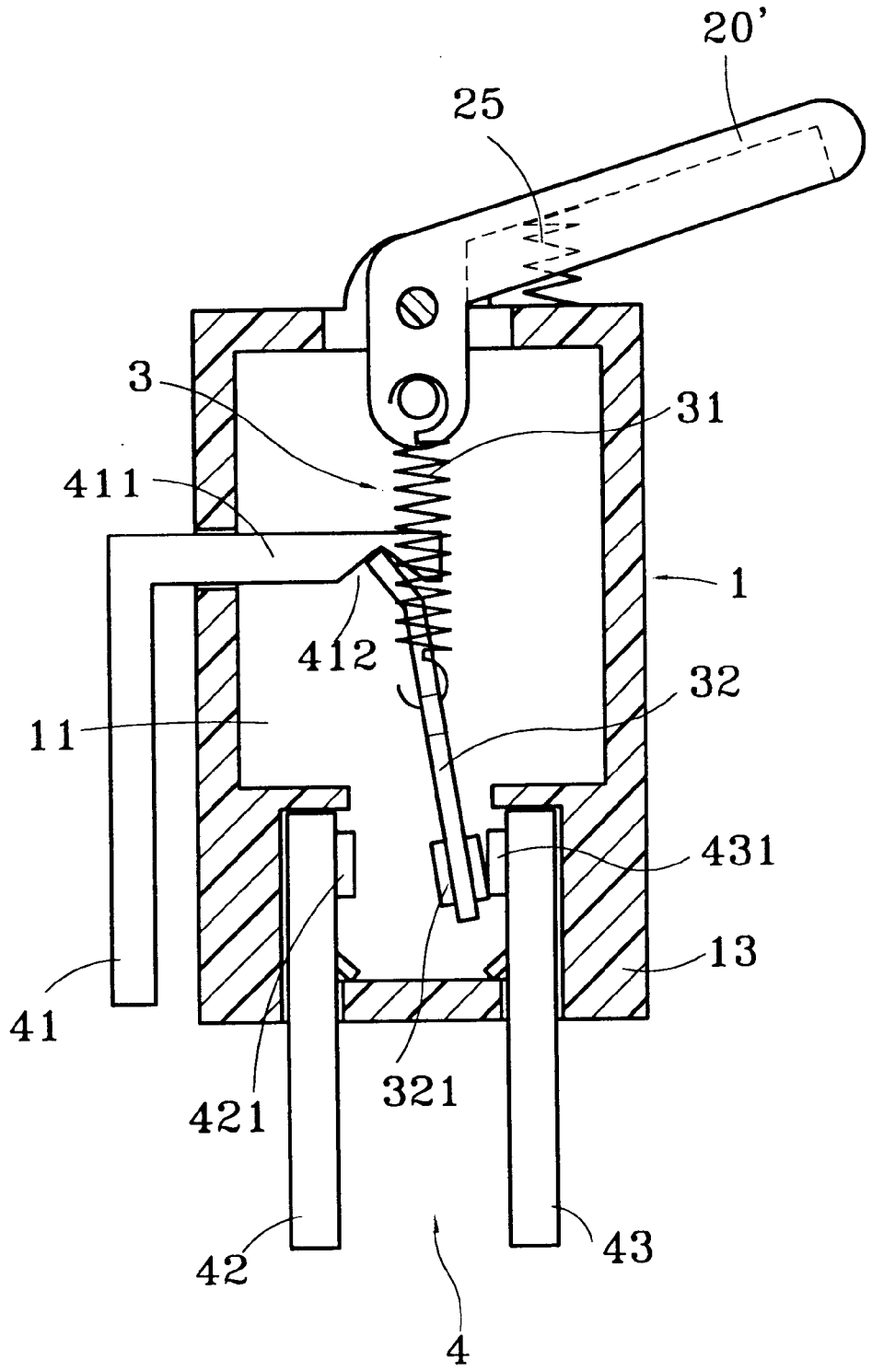
FIG. 5 is a schematic view of a fourth embodiment of this invention.

In a fourth embodiment of this invention shown in FIG. 5, a lever 20 is substituted for the press unit 2 for realizing the same object.

In the above described, while at least one preferred embodiment has been elucidated with reference to drawings annexed, it is apparent that numerous variations or modifications may be made without departing from the true spirit and scope thereof, as set forth in the claims below.

What is claimed is:

1. A switch for selectively supplying power or signals from a first conductive pin to second and third conductive pin, comprising:

a housing;

a pushbutton unit including a pushbutton extending out of said housing and a tappet formed by an extension of the pushbutton into the housing, said pushbutton unit being arranged to be moved relative to said housing between a first pushbutton position and a second pushbutton position when an external force is applied to said pushbutton;

a conductive unit fixed with respect to said housing, said conductive unit including the first, second, and third conductive pins; and a switching unit including an elastic element and a conductive sway element, said conductive sway element being arranged to selectively electrically connect the first conductive pin to either the second or the third conductive pin, said conductive sway element being pivotally engaged with said first conductive element, wherein the switching unit is coupled to the pushbutton unit by said elastic element, said elastic element being secured at a first end to the tappet and at a second end to the sway element such that when the pushbutton is in the first pushbutton position, the first end of the elastic element is in a first elastic element position and said elastic element causes the sway element to electrically connect said first and third conductive pins, and when the pushbutton is moved to said second pushbutton position, the first end of the elastic element is moved past a critical line to a second elastic element position and the elastic element causes the sway element to also move past the critical line and electrically connect the first and second conductive pins.

2. A pushbutton switch as claimed in claim 1, wherein a restoring element is disposed between said housing and said pushbutton unit; and wherein when an external force applied to said pushbutton unit is removed, said pushbutton unit is restored back to its original position by said restoring element.

3. A pushbutton switch as claimed in claim 1, wherein said pushbutton unit includes through hole, said switching unit extending through said through hole and an inner wall of said through hole forming a push-to-press portion which engages said switching unit to ensure that movement of the sway element between said third and second conductive pins and between said second and third conductive pins Occurs even when said sway element is stuck or welding to a respective one of the second and third conductive pins.

4. A pushbutton switch as claimed in claim 1, further comprising a plurality of guide portions disposed on an inner wall ol said housing for engaging portions of said tappet and guiding said pushbutton unit to move up and down in said housing between said first and second pushbutton positions.

5. A switch for selectively supplying power or signals from a first conductive pin to second and third conductive pins, comprising:

a housing;

a rocker pivotally mounted to said housing and movable between first and second rocker positions;

a conductive unit fixed with respect to said housing, said conductive unit including the first, second, and third conductive pins; and a switching unit including an elastic element and a conductive sway element, said conductive sway element being arranged to selectively electrically connect the first conductive pin to either the second or the third conductive pin, said conductive sway element being pivotally engaged with said first conductive element, wherein the switching unit is connected to the rocker by the elastic clement, said elastic element being secured at a first end to the rocker and at a second end to the sway element such that when the rocker is in the first rocker position, the first end of the elastic element is in a first elastic element position and the elastic element causes the sway element to electrically connect said first and third conductive pins, and wherein when the rocker is moved to the second rocker position, the first end of the elastic element is moved past a critical line to a second position, and the elastic element causes the sway element to also move past the critical line and electrically connect the first and second conductive pins.

6. A pushbutton switch as claimed in claim 1, wherein the rocker includes at least one extension on which a push-to-press portion is arranged to engage the sway element and ensure that movement of the sway clement between said third and second conductive pins and between said second and third conductive pins occurs even when said sway element is stuck or welding to a respective one of the second and third conductive pins.

7. A switch for selectively supplying power or signals from a first conductive pin to second and third conductive pins, comprising:

a housing;

a switching element including a lever pivotally mounted to said housing and movable between first and second lever positions;

a conductive unit fixed with respect to said housing, said conductive unit including the first, second, and third conductive pins; and a switching unit including an elastic element and a sway element for selectively electrically connecting the first conductive pin to either the second or the third conductive pin, said conductive sway element being pivotally engaged with said first conductive element, wherein the switching unit is coupled to the lever by the elastic element, said elastic element being secured at a first end to the lever and at a second end to the sway element such that when the lever is in the first lever position, the first end of the elastic element is in a first elastic element position and the elastic element causes the sway element to electrically connect said first and third conductive pins, and wherein when the lever is moved to the second lever position, the first end of the elastic element is moved past a critical line to a second position, and the elastic element causes the sway element to also move past the critical line and electrically connect the first and second conductive pins.

* * * * *